US010269291B2

(12) United States Patent
Devegowda et al.

(10) Patent No.: US 10,269,291 B2
(45) Date of Patent: Apr. 23, 2019

(54) LED DRIVER CIRCUIT WITH REDUCED EXTERNAL RESISTANCES

(71) Applicant: Intel IP Corporation, Santa Clara, CA (US)

(72) Inventors: Sachin Devegowda, Munich (DE); Henrik Leegaard, Aalborg (DK)

(73) Assignee: Intel IP Corporation, Santa Clara, CA (US)

( * ) Notice: Subject to any disclaimer, the term of this patent is extended or adjusted under 35 U.S.C. 154(b) by 242 days.

(21) Appl. No.: 14/634,228

(22) Filed: Feb. 27, 2015

(65) Prior Publication Data

US 2016/0253951 A1 Sep. 1, 2016

(51) Int. Cl.
*H05B 37/02* (2006.01)
*G09G 3/32* (2016.01)

(52) U.S. Cl.
CPC ..... *G09G 3/32* (2013.01); *G09G 2310/0267* (2013.01); *G09G 2330/025* (2013.01); *G09G 2330/028* (2013.01)

(58) Field of Classification Search
CPC ..... H05B 33/0815; H05B 33/0818; H05B 33/0827; H05B 33/0851; H05B 33/086
USPC ..... 315/307, 312, 360
See application file for complete search history.

(56) References Cited

U.S. PATENT DOCUMENTS 8,669,721 B2 * 3/2014 Watanabe ..... H05B 33/0818 315/224
2006/0214603 A1 * 9/2006 Oh ..... H05B 33/0815 315/246
2008/0278087 A1 * 11/2008 Kim ..... H05B 41/3927 315/224
2009/0174338 A1 * 7/2009 Muramatsu ..... H05B 33/0818 315/250
2010/0033110 A1 * 2/2010 Chien ..... H05B 33/0815 315/294
2010/0052569 A1 * 3/2010 Hoogzaad ..... H05B 33/0818 315/294
2012/0068605 A1 * 3/2012 Yoshitomi ..... H02P 6/30 315/117
2012/0299480 A1 * 11/2012 Peting ..... H05B 33/0815 315/113
2014/0042932 A1 * 2/2014 Tomasovics ..... H05B 33/086 315/307

* cited by examiner

*Primary Examiner* — Tung X Le
(74) *Attorney, Agent, or Firm* — Compass IP Law PC

(57) ABSTRACT

An apparatus is described that includes an LED driver circuit having a series of frequency dividers to divide a clock signal's frequency to produce a frequency divided clock signal. The series of frequency dividers are coupled to a frequency multiplier circuit. The frequency multiplier circuit is to multiply the frequency divided clock signal's frequency by an amount proportional to a desired LED intensity.

20 Claims, 14 Drawing Sheets

LED DRIVER CIRCUIT WITH REDUCED EXTERNAL RESISTANCES

FIELD OF INVENTION

The field of invention pertains generally to electronic circuitry and more specifically to an LED driver circuit with reduced external resistances.

BACKGROUND

Computing systems configured for use by a user typically include a display for presenting information to the user. A common display type is a light emitting diode (LED) display that arranges a number of LEDs in an array and manipulates signals provided to the LEDs to control the specific content presented on the display. Like many peripheral devices, a display such as an LED display has a mixture of digital and external analog electronic components. As a general rule, solutions having external analog electronic components are more expensive to implement than solutions integrated entirely on a single semiconductor chip. As such, lower cost solutions are obtainable where the use of external analog components can be mitigated in favor of digital circuitry.

BRIEF DESCRIPTION OF THE DRAWINGS

A better understanding of the present invention can be obtained from the following detailed description in conjunction with the following drawings, in which.

DETAILED DESCRIPTION

Figure 1A:
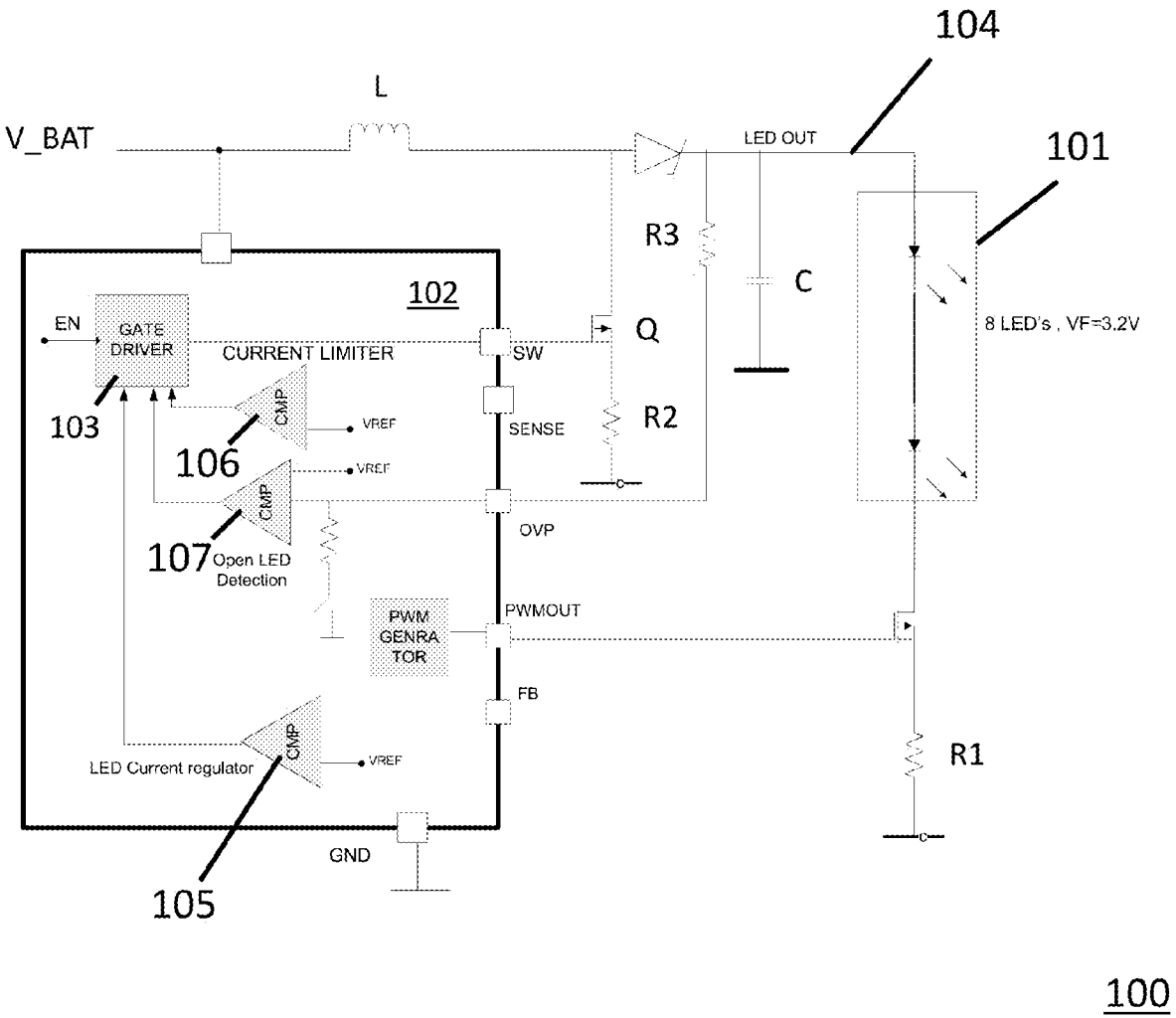
Fig. 1a (prior art)
FIG. 1*a* shows a schematic depiction of a prior art LED driver circuit.

FIG. 1*a* shows a prior art LED driver circuit 100. An LED driver circuit 100 is a circuit designed to drive a number of LEDs 101 arranged in series. A serial arrangement of LEDs are commonly found, for example, in LED display devices that include an array of LEDs. A string of LEDs arranged in series may correspond to a section of a row or column within the LED array.

As each LED in series has its own respective forward voltage, the total voltage needed across the chain of LEDs may exceed the supply voltage of the system. For example, a computer may be designed to include a 1.8 V supply voltage (V_BAT). A string of 8 LEDs each having a forward voltage of 0.4 V would, however, require a voltage of 3.2 V (V_LED) to be applied across the entire LED string 101.

As such the LED driver 100 is designed to implement a "boost" circuit that uses an inductor L to "boost" the lower system supply voltage (e.g., 1.8 V) up to a higher voltage (e.g., 3.2 V). As observed in FIG. 1*a*, the LED driver circuit 100 includes a semiconductor chip 102 and external components (e.g., inductance L, LEDs 101, etc.). The semiconductor chip 102 includes a gate driver circuit 103 that turns a power FET Q "on" or "off" depending on whether the inductor L is storing charge (charging) or releasing charge (discharging).

Figure 1B:
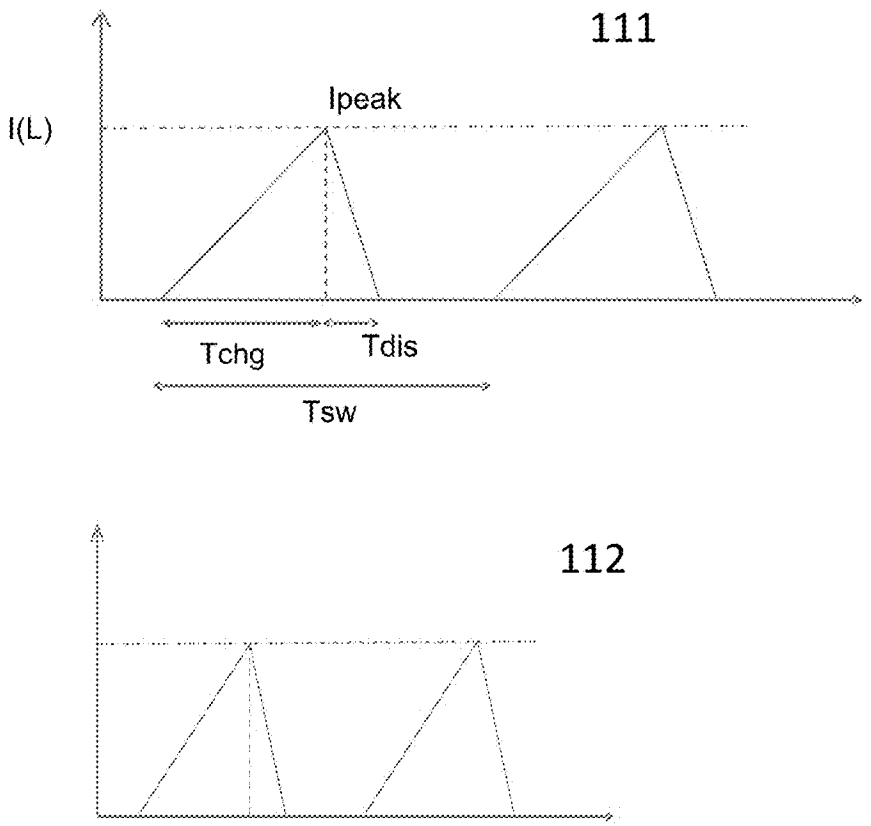
Fig. 1b (prior art)
FIG. 1*b* shows a schematic depiction of inductor current of the LED driver circuit of FIG. 1*a;*

Here, inset FIG. 1*b* depicts an example 111 of the inductor current as a function of time. Initially, the FET Q is turned "on" by the gate driver 103. The turning of the FET Q on pulls current I through the inductor L which causes the current through the inductor to "ramp up" over charge time Tchg. When the current through the inductor reaches a pre-determined peak value I_peak, the gate driver circuit 103 turns FET Q "off" after which the inductor L releases its charge into capacitor C over discharge time Tdis. The peak current I_peak is understood to be a function of inductance L, supply voltage, characteristics of FET Q, the number of LEDs, the size of capacitance C, etc. As such, the gate driver 103 can be designed/configured to simply turn FET Q "off" after time Tchg has passed after FET Q is turned "on".

Over the course of Tdis while the inductor L discharges into capacitor C, the voltage on node 104 rises above the value of the supply voltage V_BAT (which may be provided by a battery). This effect corresponds to the supply voltage "boost" that is provided by the boost circuit. Sometime after the FET Q was first turned on and after the inductor has discharged the process repeats with the gate driver circuit 103 turning FET Q back "on". As such, as observed in FIG. 1*b*, the inductor current has a periodicity of Tsw. Said another way, the LED driver circuit 100 operates with a frequency f_sw=1/Tsw.

The intensity at which the LEDs will emit light is proportional to the inductor current's frequency of operation f_sw. Comparing exemplary signal 111 with exemplary signal 112, note that exemplary signal 112 has a higher frequency of operation f_sw than exemplary signal 111. By increasing the frequency of operation of the circuit, the voltage on node 104 will be "boosted" more frequently resulting in a higher voltage on node 104. Thus if the frequency of the circuit 100 increases the voltage on node 104 will rise. Contra-wise, if the frequency of the circuit 100 decreases the voltage on node 104 will fall.

The intensity of the light emitted by the LEDs 101 is controlled through a feedback loop implemented with a first comparator circuit 105 and an external resistor R1. Here, the intensity of the light emitted by the LEDs 101 is proportional to the current that flows through the LEDs 101. The current that is flowing through the LEDs 101 is effectively measured by measuring the voltage across external resistor R1 that is in series with the LEDs 101. The measured voltage is compared by comparator 105 against a reference voltage that corresponds to the desired LED intensity.

If the measured voltage is less than the reference voltage, comparator circuit 105 sends a signal to the gate driver 103 that causes its frequency of operation f_sw to increase (thereby raising the voltage on node 104 and driving more current through the LEDs 101). If the measured voltage is greater than the reference voltage, comparator circuit 104 sends a signal to the gate driver 103 that causes its frequency of operation to decrease (thereby lowering the voltage on node 104 and driving less current through the LEDs 101). Eventually the voltage across R1 will stabilize approximately at the reference voltage which corresponds to the desired current driven through the LEDs 101 for a desired emitted light intensity.

The LED driver circuit 100 of FIG. 1 also includes two protective features. A first protective feature, referred to as "current overprotection" prevents the inductor from storing too much current (for subsequent discharge into capacitor C). Here, when FET Q is "on" and pulling current through inductor L, a second comparison circuit 106 measures the voltage across a second external resistor R2. Here, when the voltage across R2 reaches a value that corresponds to a maximum permissible current, comparator 106 sends a signal to the gate driver circuit to turn FET Q "off". Note that conceivably the second comparator 106 could also be used to detect I_peak and cause the circuit to transition from inductor charge (FET Q "on") to inductor discharge (FET Q "off") during normal operation.

Another protective feature is "open LED detection". Open LED detection detects if one or more LEDs are no longer working in which case the voltage on node 104 will be larger than designed for. As such, open LED detection acts to reduce the voltage on node 104 by causing the gate driver 103 to turn FET Q off and shut the circuit down. A third comparator circuit 107 and external resistance R3 is used to perform open LED detection. Here, a reference voltage is provided to comparator circuit 107 that corresponds to the voltage that should appear on node 104 if all the LEDs are working. If at least one LED fails, the voltage on node 104 will rise above the reference voltage in which case comparator 107 will send a signal to the gate driver circuit 103 which will shut the circuit down.

A problem is that the external resistances R1, R2 and R3 cause the entire driver circuit 100 to have increased cost owing to the increased circuit board surface area consumption and increased bill of materials parts count/cost.

Figure 2:
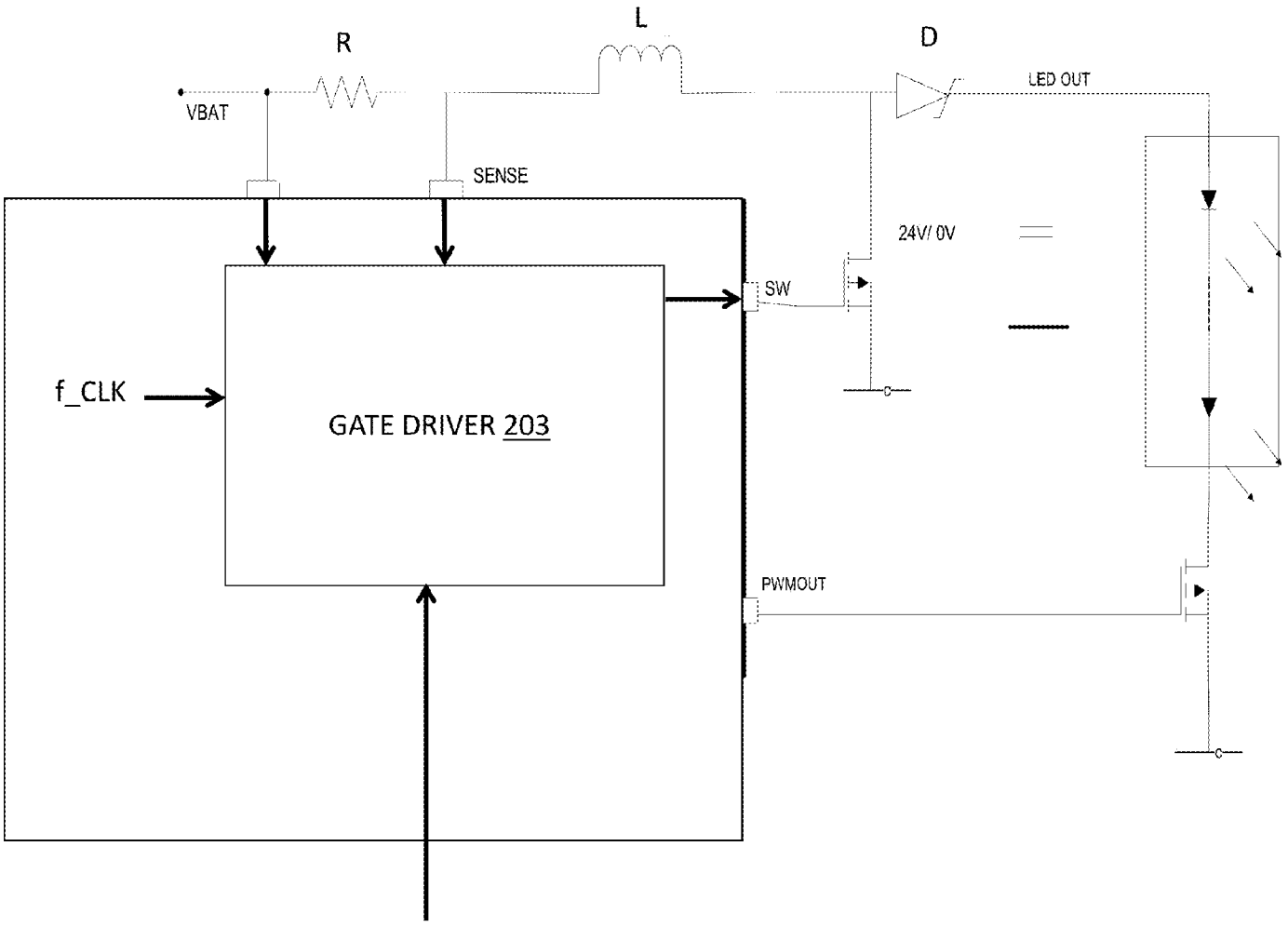
FIG. 2 shows an improved LED driver circuit.

FIG. 2 shows an improved circuit that has only one external resistance R and yet still includes the features of a working LED driver circuit including current overprotection and open LED detection. As will be more clear in the following description, the circuit of FIG. 2 relies on a novel theoretical realization of LED driver circuitry that permits the use of digital processing circuitry instead of multiple comparator based feedback loops that rely on external resistance as with the prior art circuit of FIG. 1*a*.

With respect to the setting of LED intensity values, Appendix I provides a detailed theoretical proof that demonstrates that the "correct" frequency of operation f_sw for a desired LED intensity can be expressed as:

$$f_sw = A * f_clk * LED_desired \quad \text{Eqn. 1}$$

where

LED_desired is the desired LED intensity, f_clk is the frequency of the LED driver circuit's master clock and $$A = (R*(V_LED + Vfd - V_BAT)*I_max)/(0.5*V_CMP*(V_BAT - V_CMP)*K1*N). \quad \text{Eqn. 2}$$

For A above: 1) R is the resistance of the external resistor observed in FIG. 2; 2) V_LED is the forward voltage across the string of LEDs (e.g., 8 LEDs×0.4 V/LED=3.2 V); 3) Vfd is the forward voltage across the schottky diode D; 4) V_BAT is the supply voltage; 5) I_max is the current driven through the LED string when the emitted LED intensity is at a permitted maximum; 6) V_CMP is the voltage drop across resistor R when the inductor current is at its peak (I_peak); 7) K1 is the number of master clock cycles needed to reach I_peak after FET Q is turned on; and, 8) N is the total number of different LED intensity settings.

From Eqn. 1, the correct frequency of operation of the circuit can be directly determined for any desired LED intensity simply by multiplying the desired LED intensity by A. From Eqn. 2, A can be more easily put into a form that can be readily be reproduced with electronic circuitry as:

$$A = (1/K1)*(1/f(VBAT)) \quad \text{Eqn. 3}$$

where $$f(VBAT) = (0.5*V_CMP*(V_BAT - V_CMP)*N)/(R*(V_LED + Vfd - V_BAT)*I_max). \quad \text{Eqn. 4}$$

Substitution of Eqn. 3 into Eqn. 1 yields:

$$f_sw = (1/K1)*(1/f(VBAT)*f_clk*LED_desired \quad \text{Eqn. 5}$$

which provides the primary function of the gate driver circuit 203 of FIG. 2. That is, the gate driver circuit 203 of FIG. 2 receives a master clock signal having a frequency of f_clk along with some parametric values to establish division by K1 and division by f(VBAT) as well as receives the desired LED intensity. In response to its receipt of these input signals/values, the gate driver circuit 203 generates the on/off signal for FET Q having the correct frequency for producing the desired LED intensity.

Figure 3:
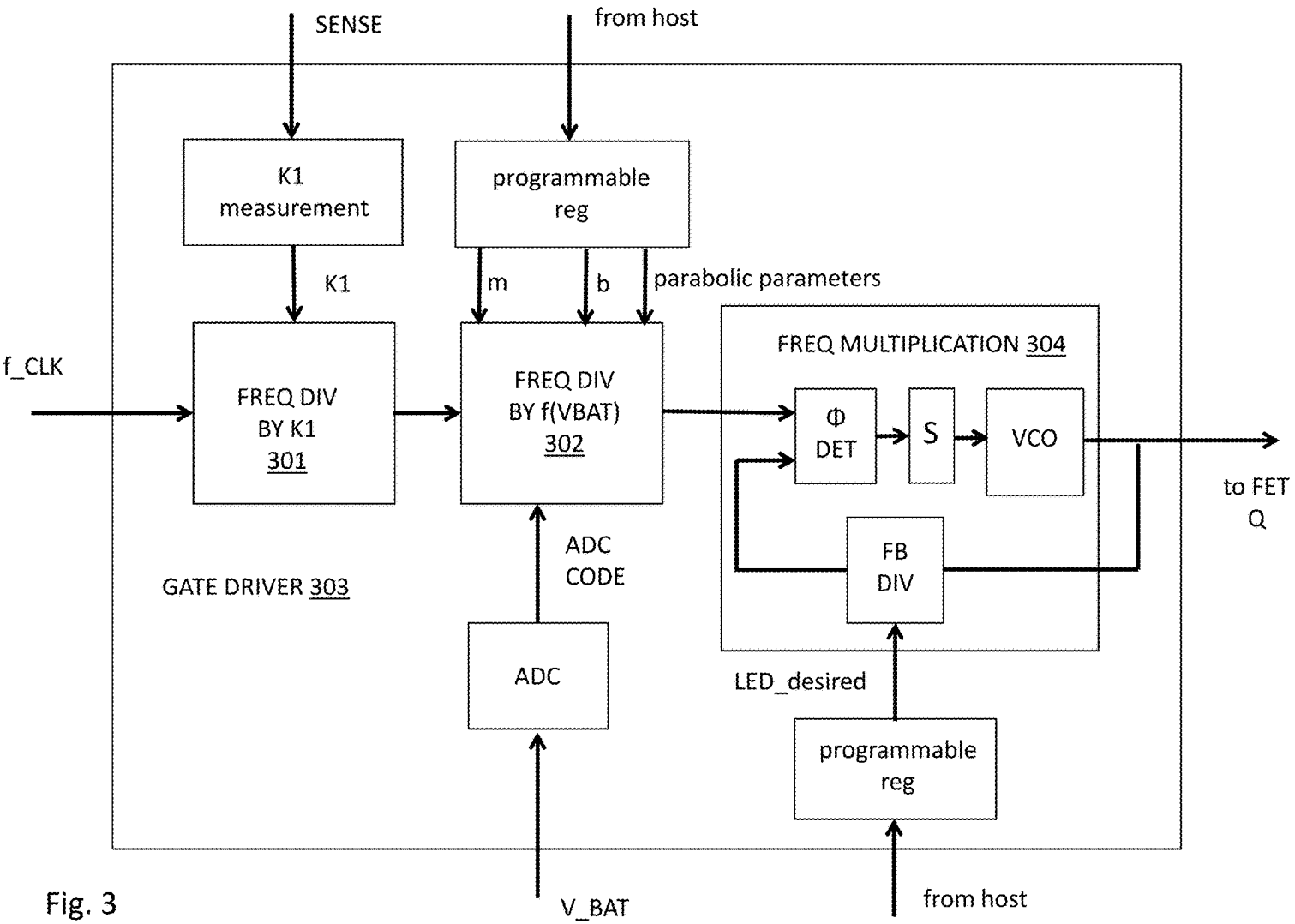
FIG. 3 shows an embodiment of a gate driver circuit of the improved LED driver circuit of FIG. 2.

FIG. 3 shows a more detailed embodiment 303 of the gate driver circuit 203 of FIG. 2. Here, a master clock having frequency f_clk is provided to a first divider circuit 301 that divides f_clk by a constant K1. The output of the first divider circuit 301 is then provided to a second divider circuit 302 that further divides the frequency of the signal down by f(VBAT).

Thus, the frequency of the output signal of the second divider circuit 302 corresponds to (1/K1)*(1/f(VBAT))*f_clk. The output of the second divider circuit 302 is then provided to a frequency multiplier circuit 304 that multiplies the frequency of the output signal from the second divider circuit 302 by the desired LED intensity (LED_desired). The frequency multiplier circuitry 304 may be implemented, e.g., with a phase locked loop circuit or delay locked loop circuit having a divider in its feedback path that is set equal or equivalent to the desired LED intensity. The output of the entire channel of the gate driver 303 of FIG. 3 will produce a signal having a frequency f_sw that is the correct frequency at which to switch FET Q "on" for the desired LED intensity.

As described in more detail further below, the K1 division factor is determined by an on-chip measurement circuit that monitors the SENSE input that is coupled to external resistor R, the f(VBAT) division is determined from a number of parametric values that are programmed into the chip and a digital representation of the V_BAT voltage. The desired LED intensity is also programmed into register space of the circuit.

Figure 4:
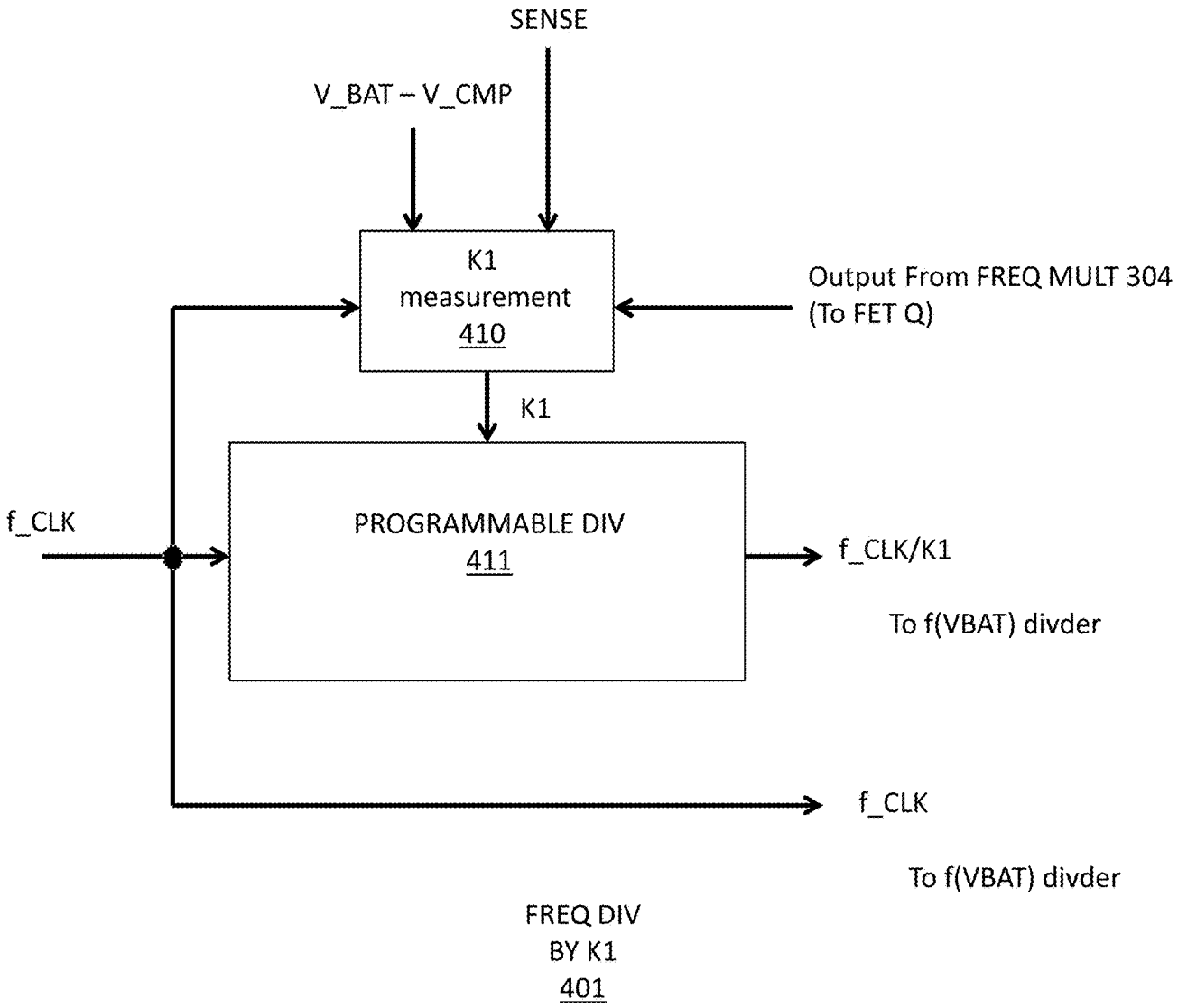
FIG. 4 shows an embodiment of a first frequency division stage of the gate driver circuit of FIG. 3.

FIG. 4 provides an embodiment 401 of the first divider circuit 301 that frequency divides by a factor of K1. K1 is determined by a measurement circuit 410 that counts the number of master clock cycles needed to ramp the inductor current from a value of 0 when FET Q is first turned on to a value of I_peak at which FET Q is turned off. Thus, K1 is a measurement of Tchg which in turn is effectively a measurement of the inductive time constant and is the mechanism by which the value of the inductance L works its way into Eqn. 2. Measurement circuit 410 is implemented with a counter that begins counting master clock cycles as soon as FET Q is turned on by the gate driver circuit and stops counting as soon as the inductor current ramps to I_max (which is detected by monitoring the SENSE input that is coupled to resistance R). The start of the count is synchronized with the gate driver output turning on FET Q. The counting is stopped with a comparator recognizes that the voltage drop across R is equal to R*(I_peak)=V_CMP. The first comparator therefore receives a reference voltage of V_BAT−V_CMP. V_CMP is understood to be a predefined setting based on the value of R and a predetermined/desired value of I_peak. It may be entered through programmable register space (not shown)

The first divider circuit 401 also includes a programmable divider 411 that receives the value K1 directly. Upon the programmable divider 411 being loaded with a specific value for K1, the programmable divider 411 will divide the frequency of the input signal by K1. For example, if a value of K1=50 is programmed into divider 411, the programmable divider 411 will trigger a new cycle at its output every $50^{th}$ cycle observed at its input As mentioned above, referring back to FIG. 2, the second frequency divider circuit 302 divides the frequency of the output signal from the first frequency divider 301 by f(VBAT). That is, the second frequency divider 302 attempts to divide the frequency of the clock signal generated by the first divider 301 by an amount that is expressed in Eqn. 4 and which is repeated below as Eqn. 6a for convenience.

$$f(VBAT)=(0.5*V_CMP*(V_BAT-V_CMP)*N)/(R*(V_LED+Vfd-V_BAT)*I_max). \quad \text{Eqn. 6a}$$

A design technique to simplify the f(VBAT) division includes graphically approximating f(VBAT) as a linear function of V_BAT where V_BAT is provided by an analog to digital converter (ADC) that receives the actual V_BAT supply voltage. More precisely, Eqn. 6a above is approximated as:

$$f(VBAT)=m(ADC_CODE+b \quad \text{Eqn. 6b}$$

where m is the slope and b is the vertical axis intercept of a line that is graphically plotted as a function of the ADC output ADC_CODE. Integer approximations of the slope m and the vertical axis intercept b are determined from a graphical plot of Eqn. 6b and programmed into the f(VBAT) division circuitry (here, division is more straight forward with integer values). Additional "residue" division circuitry is also instantiated to approximately correct for any error introduced by the integer approximations of m and b. A specific example is described more thoroughly immediately below.

Consider a specific exemplary situation in which V_BAT has an operational range from 2.8V to 5.2V. In this case, a five bit ADC can easily express the different V_BAT voltage levels. Here, 5.2V−2.8V=2.4V is the voltage spread of V_BAT. Designing an ADC to increment one output code bit every 0.1 V would correspond to an ADC having an output bit width large enough to express 24 different values (2.4 V/0.1 V=24). As such, a five bit ADC (which has 2^5=32 different output codes) could easily express these 24 different values. Centering the 2.8 V to 5.2 V_BAT voltage range across the 32 ADC output values would correspond to the low end V_BAT value of 2.8V producing an ADC output value of 00010=4, and, the high end V_BAT value of 5.2 V producing an ADC output value of 11010=28. That is, of the seven "unused" ADC output code values, the lowest four are put on the low end (0 through 3) and the highest three are put on the high end (29 through 31).

Figure 5:
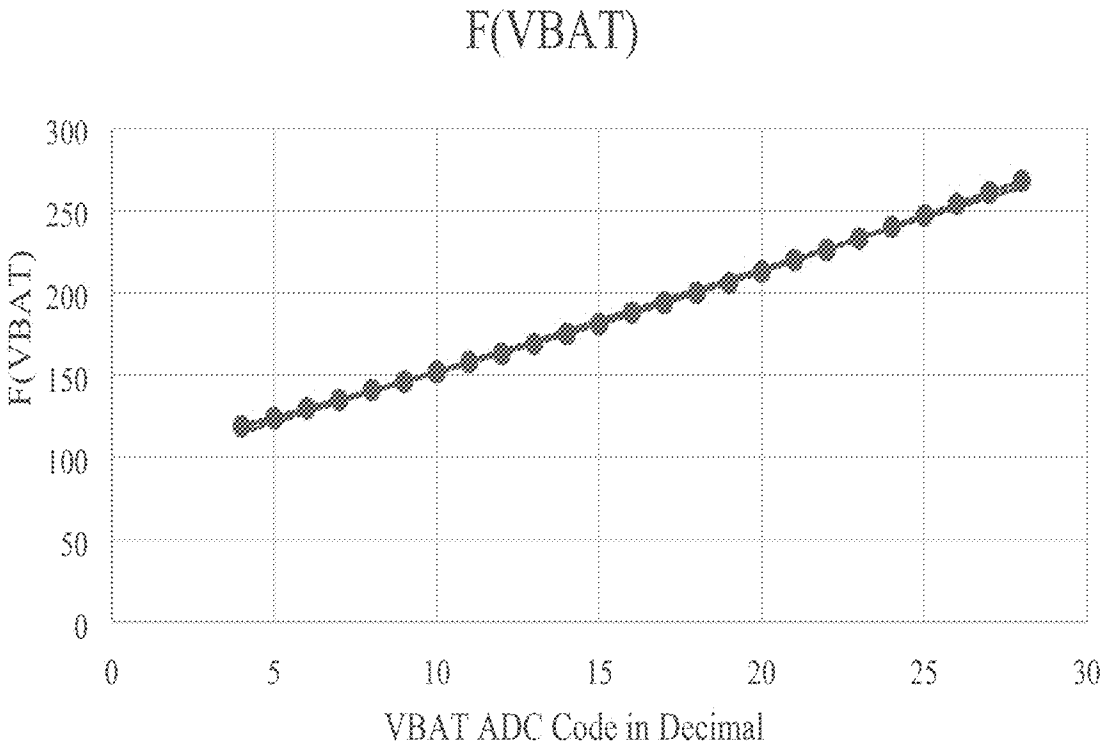
FIG. 5 shows a graphical depiction of f(VBAT) as a function of ADC_CODE.

Consider the following additional characteristics of the instant example: 1) there are 8 LEDs having a total V_LED of 3.15V; 2) Vfd of the Schottky diode D is 0.6V; 3) V_CMP is 0.2V; and, 4) I_max is 0.04 Amps. Plugging these values into Eqn. 6a above and then plotting them as a function of the ADC code values for V_BAT discussed just above yields the graph observed in FIG. 5. As the observed trend is substantially linear, straightforward linear analysis from the plot of FIG. 5 yields an approximation for Eqn. 6b as follows:

$$f(VBAT)=(6.2*ADC_OUTPUT_CODE)+90.372 \quad \text{Eqn. 7}$$

Thus, for this particular example, the second frequency divider 302 could be designed to divide the frequency of the signal received from the first frequency divider 301 by an amount expressed by Eqn. 7. Unfortunately, division by fractional amounts is not entirely straightforward. Hence, according to one embodiment, the f(VBAT) frequency division is performed by a number of frequency division stages, a first which performs fairly straight forward integer division according to:

$$First_f(VBAT)_Division=(6*ADC_OUTPUT_CODE)+90 \quad \text{Eqn. 8a}$$

and a second division that attempts to correct for the simplification of Eqn. 8a by dividing by a "residue" amount expressed as $$Second_f(VBAT)_Division=\text{Eqn. 5}-\text{Eqn. 6}a \quad \text{Eqn. 8b}$$

Here, Eqn. 8a corresponds to the "primary" integer division for simpler divider circuitry and Eqn. 8b corresponds to the residue correction that is applied to the primary division to provide a more accurate/correct amount of overall frequency division.

Figure 6:
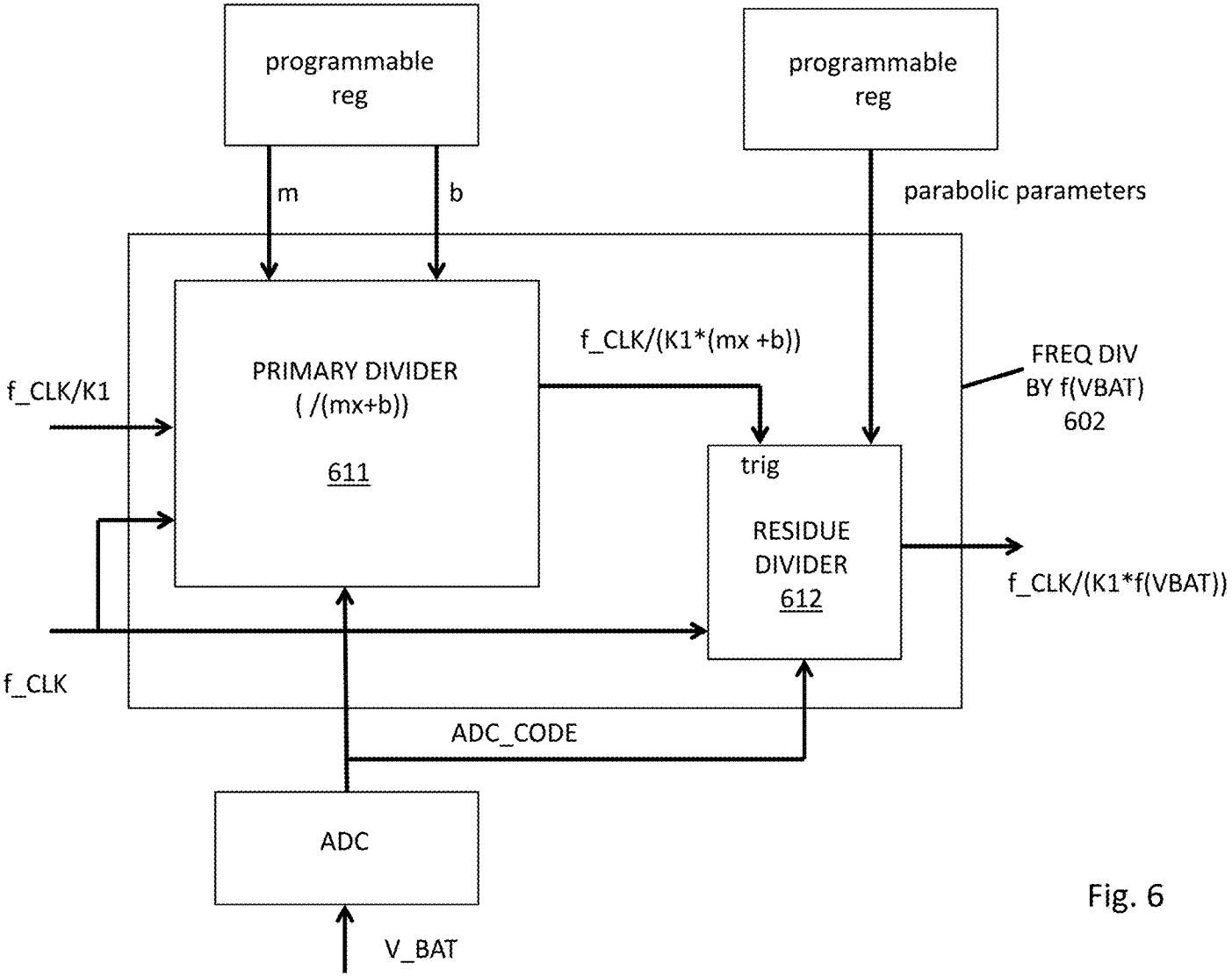
FIG. 6 shows an embodiment of second frequency division stage of the gate driver circuit of FIG. 3.

FIG. 6 shows a high level depiction 602 of the f(VBAT) frequency division circuit discussed just above. A first "primary" division stage 611 receives the output of the K1 division stage which includes both the f_clk/K1 signal as well as the f_clk signal. A second "residue" division stage 612 receives the output signal from the primary division stage 611. For the particular example being discussed herein, the primary division stage 611 performs the frequency division expressed in Eqn. 8a and the residue division stage 612 performs the frequency division expressed in Eqn. 8b.

Figure 7:
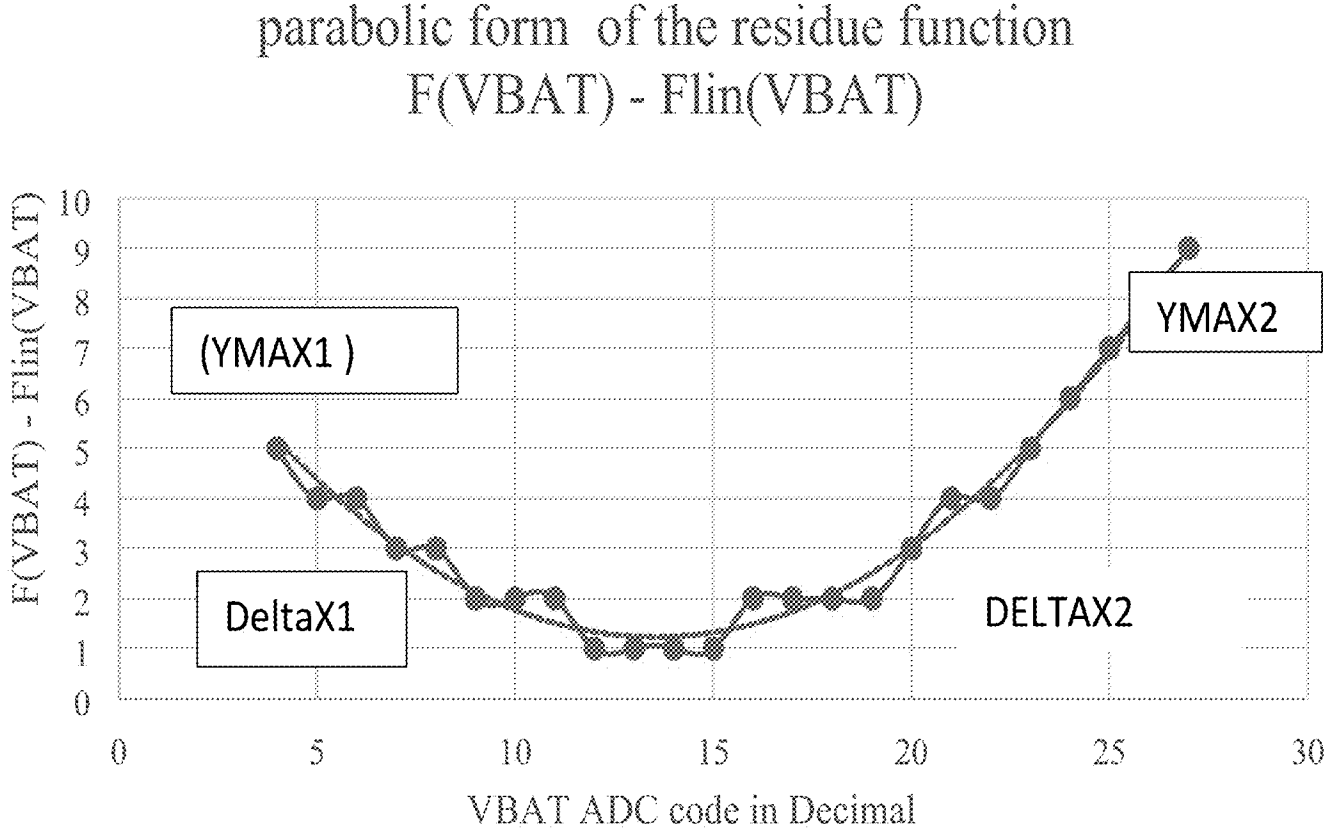
FIG. 7 shows a graphical depiction of a parabolic residue correction for the second frequency division stage of FIG. 6.

FIG. 7 shows another graphical technique for determining the actual division to be performed by the residue division stage 612. Here, FIG. 7 shows a plot of Eqn. 8b for the present example being discussed herein. That is, FIG. 7 shows a plot of $$((6.2*ADC_OUTPUT_CODE)+90.372)-((6*ADC_OUTPUT_CODE)+90)$$

as a function of the ADC output code values for a V_BAT range of 2.8 to 5.2 V. The observed graphical plot is clearly parabolic and can therefore be approximated by a parabolic equation. A circuit for adjusting the frequency division by an amount equal to the observed parabolic trend of FIG. 7 is discussed in more detail further below with respect to FIG. 9.

Figure 8:
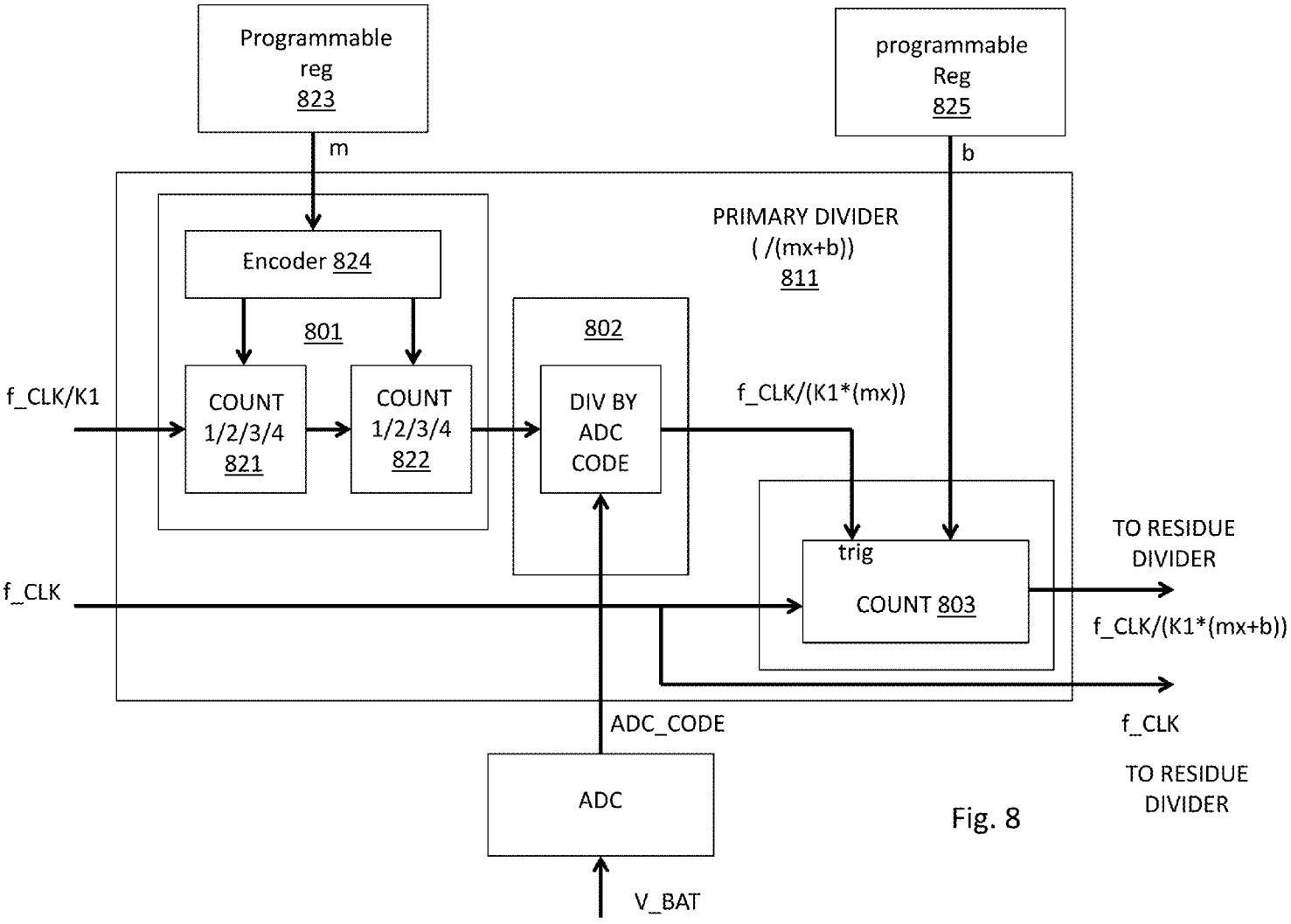
FIG. 8 shows an embodiment of a primary frequency divider of the second frequency division stage.

FIG. 8 pertains to an embodiment of the primary division stage circuitry 811 that implements an amount of frequency division equal to First_f(VBAT)_Division as expressed in Eqn. 8a. As observed in the circuit design of FIG. 8, a first divider circuit 801 is implemented with a pair of 2 bit counters 821, 822 each of which are provided a specific configuration setting in order to count to a correct value for a specific frequency division (a two bit counter has the ability to count to 4). Here, division by any of 4, 5, 6 or 7 is possible by arranging the pair of counters 821, 822 to effectively count as an operative whole to 4, 5, 6 or 7 where the second counter increments a count in response to a toggle by the first counter.

That is: 1) to effect division by 4 the first counter 821 counts to 2 and the second counter 822 counts to 2; 2) to effect division by 5 the first counter 821 counts to 3 and the second counter 822 counts to 2; 3) to effect division by 6 the first counter 821 counts to 3 and the second counter 822 counts to 3; 4) to effect division by 7 the first counter 821 counts to 4 and the second counter 822 counts to 3. A register 823 that is programmed with the correct integer count/division value for the specific design (which is 6 with respect to the specific example presently being discussed as reflected in Eqn. 8a) is coupled to an encoder 824 which configures the pair of counters 821, 822 with the correct count settings based on the value that is programed into the register 823. The register 823 permits the circuit to support a wide range of possible designs.

A second divider circuit 802 operates to effect frequency division by an amount equal to the ADC_OUTPUT_CODE. As such, in an embodiment where the ADC_OUTPUT CODE can be any value between 4 and 28, the second divider circuit is implemented with a five bit counter that can be configured to count to any value within a range of 4 to 28. A second register (not shown) that is coupled to receive the output of the ADC is coupled to the second divider circuit 802 to provide it with the ADC_OUTPUT_CODE value.

The output of the second divider circuit 802 is then provided to a "trigger" or "start" input of another counter circuit 803 that counts a specific number of master clock cycles (having frequency f_clk) after the trigger/start signal from the second divider circuit 802 is raised to effectively count the correct total number of master clock cycles for the First_f(VBAT)_Division calculation. That is, the output of the third counter circuit 803 provides a signal that corresponds to the master clock having its frequency divided down by an amount equal to the value of First_f(VBAT)_Division (e.g., as expressed in Eqn. 8a). With respect to the specific example being discussed at length herein, the third divider circuit 803 includes a counter 803 that counts to a value of 90 consistent with the presence of that term in Eqn. 8a. Another programmable register 825 is used to provide the value of "90" to the third counter circuit 803 (so that the same circuit can be used to support other designs having different first division equations than the specific division of Eqn. 8a). The output of the third counter circuit 803 is then directed to the residue division stage.

Figure 9:
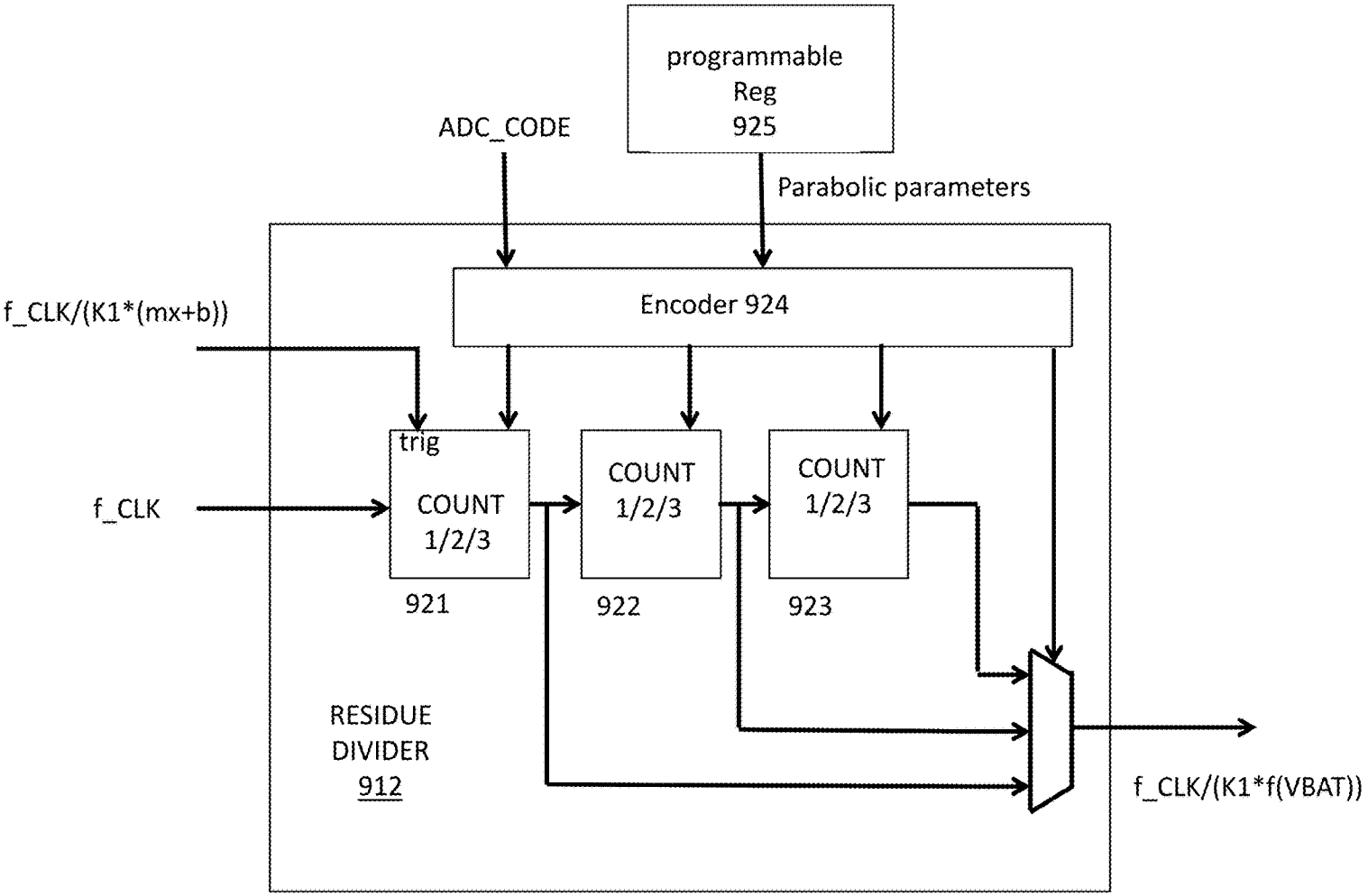
FIG. 9 shows an embodiment of a residue frequency divider of the second frequency division stage.

FIG. 9 shows an embodiment 912 of the circuit design for the residue division stage. The residue division stage is similar to the counter circuit 803 in that it is designed to count for a number of additional master clock cycles based on a "start" or "trigger" signal. Here, however, the "start" or "trigger" signal is provided by the primary divider circuit 811 and only a relatively few more master clock cycles at frequency f_clk are counted out in order to effect the modest correction that the residue division stage 912 provides.

As observed from the graphical depiction of the FIG. 7, the residue division stage 912 is designed to count up to any integer value within a range of 1 to 9 inclusive depending on the particular value of the ADC_OUTPUT_CODE. As such, the residue division stage is implemented as a series of three counters 921, 922, 923 each capable of counting up to 1, 2, or 3 depending on the ADC_OUTPUT_CODE input value and the specific shape of the parabola. The correct overall counting performed by the residue division stage 912 is configured by setting the appropriate count value for each of the three counter circuits 921, 922, 923.

For example, if the residue division stage 912 is to count one more 1 clock cycle, a first of the counters 921 will count one master clock cycle after the start/trigger signal is raised and the remaining counters are bypassed. If the residue division stage it to count 2 master clock cycles, the first of the counters 921 will count two clock cycles and the second and third counters are bypassed. If the residue division stage is to count 3 master clock cycles, the first of the counters 921 will count three clock cycles and the second and third counters are bypassed. If the residue division stage is to count 4 master clock cycles, the first counter 921 counts to a value of 2, the second counter counts 922 to a value of 2 and the third counter 923 is bypassed. If the residue division stage 912 is to count 5 master clock cycles, the first counter 921 counts to a value of 3, the second counter 922 counts to a value of 2 and the third counter 923 is bypassed. The progression continues in kind. Ultimately, if the residue division stage 912 is to count to a value of 7 or higher all three of the counters 921, 922, 923 are used (none or bypassed).

In a further embodiment, the counters 921, 922, 923 are implemented as 1, 2, 2.5 or 3 counters to provide for even finer granularity correction. Here, the curve of FIG. 7 (rather than just the discrete values) is more closely approximated by permitting count values in 0.5 increments. For example, referring briefly to FIG. 7, for an ADC_OUTPUT_CODE of 8 or 19, the residue division stage 912 would be configured to count to 2.5 by configuring the first counter to count to a value of 2.5.

As observed in FIG. 9 an encoder circuit 924 is designed to provide the correct configurations for the counters and any bypass paths based on the parabolic fit as a function of the ADC_OUTPUT_CODE value and the parabolic curve parameters. Parameters for the parabolic fit are programmed into a register 925 and provided to the encoder 924.

The output of the residue division stage corresponds to the master clock signal having been divided down by an amount K1*f(VBAT). As discussed in relation to Eqn. 5 and FIG. 3, this signal then has its frequency multiplied by a value that represents LED_desired to produce a signal having the correct frequency for the inductor current to drive the LEDs to the correct illumination intensity.

Figure 10:
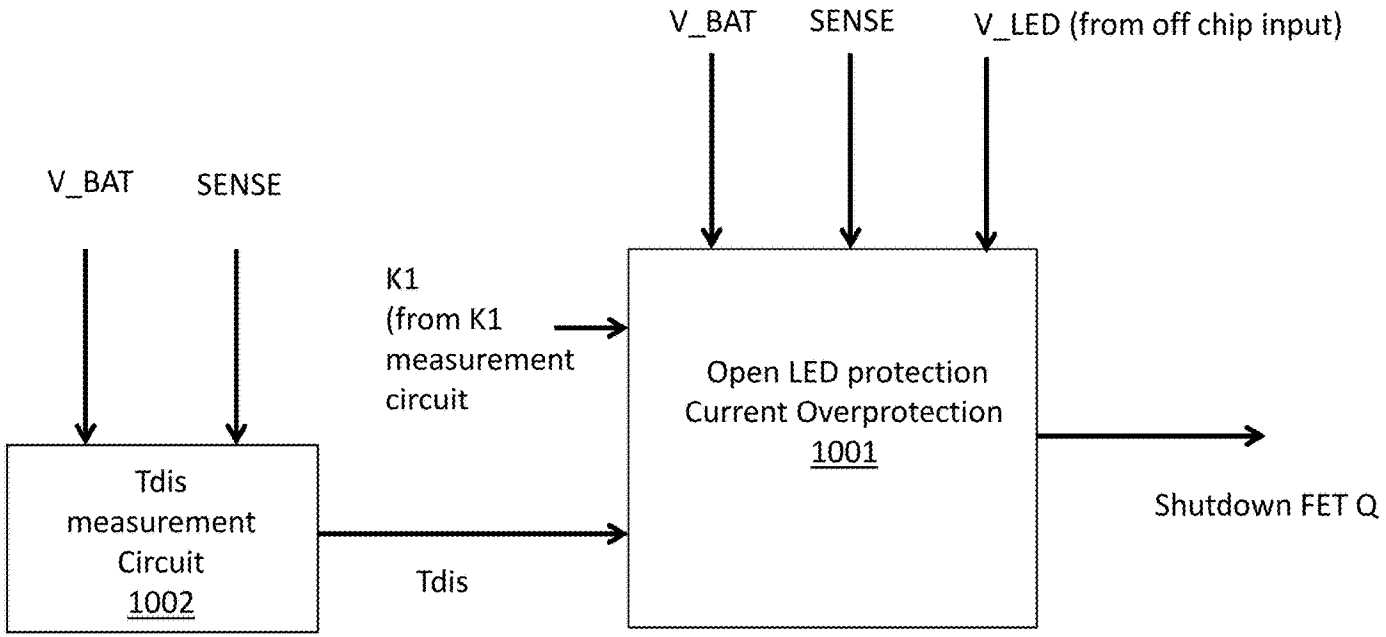
FIG. 10 shows an embodiment of an over protection circuit.

FIG. 10 shows additional circuitry that can be used to perform "open LED protection" and "current overprotection". Here, Appendix II provides another theoretical derivation that shows that, under normal operation, the voltage drop across the chain of LEDs (V_LED) can be approximated as:

$$V_LED=[1+(Tchg/Tdis]]*V_BAT \qquad \text{Eqn. 9}$$

where Tchg is the inductor charge time and Tdis is the inductor discharge time. A circuit for measuring the inductor charge time (represented as parameter K1) was discussed above with respect to FIG. 4. The K1 value output from the K1 measurement circuit of FIG. 4 is also used as an input to the protection detect circuit 1001.

Another similar circuit 1002 counts the number of clock cycles it takes for the inductor to discharge to effectively calculate Tdis. In an embodiment, the circuit calculates Eqn. 9 outright and compares the calculated value of V_LED to an actual measured value of V_LED that is provided as an input signal to the semiconductor chip. If the comparison demonstrates that the actual measured V_LED is significantly larger than the calculated V_LED and the measured Tdis is larger than an expected/nominal/normal value (which indicates the inductor is discharging exponentially rather than linearly) an open LED event is detected and the circuit is shut down.

Current overprotection is performed by measuring the voltage drop across the external resistance R and if the voltage drop exceeds R*(maximum permissible current) then an over current event is detected and the circuit is shut down. Measuring the voltage drop across R can be accomplished by calculating V_BAT−SENSE.

Figure 11:
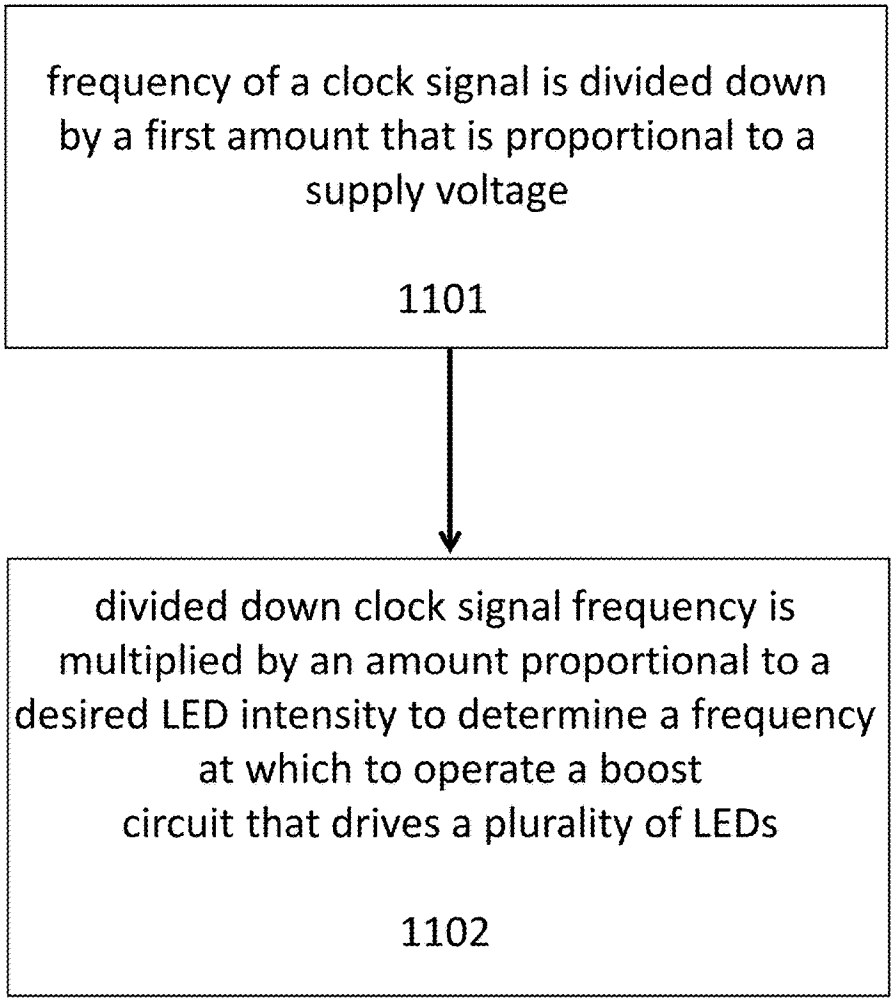
FIG. 11 shows a method performed by the improved LED driver circuit.

FIG. 11 shows a method performed by an LED driver circuit as described herein. A frequency of a clock signal is divided down by a first amount that is proportional to a supply voltage 1101. Then the divided down clock signal frequency is multiplied by an amount proportional to a desired LED intensity to determine a frequency at which to operate a boost circuit that drives a plurality of LEDs.

Figure 12:
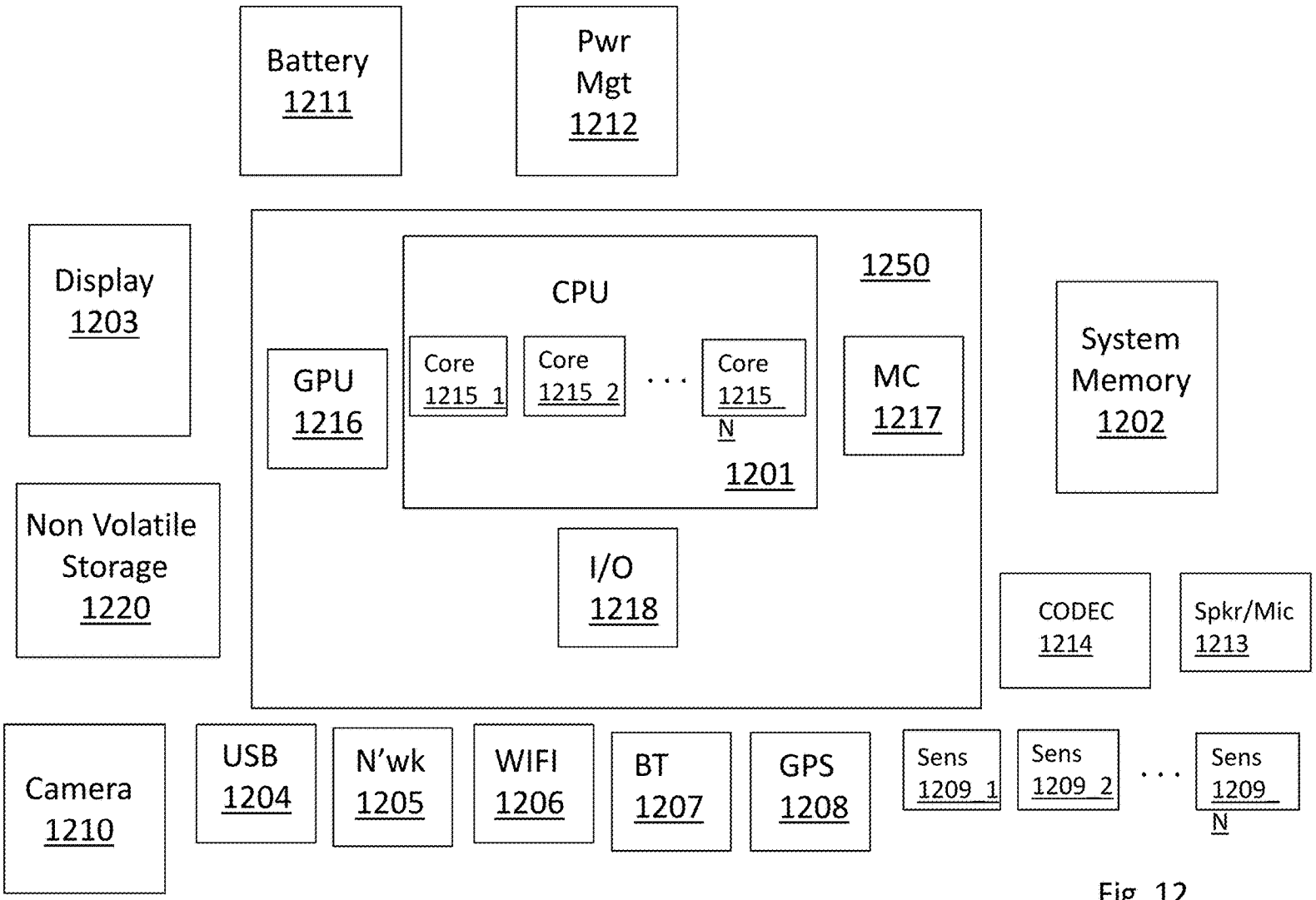
FIG. 12 shows an embodiment of a computing system that incorporates an LED driver circuit such as any of the embodiments of the improved LED driver circuit discussed herein.
Figure 13:
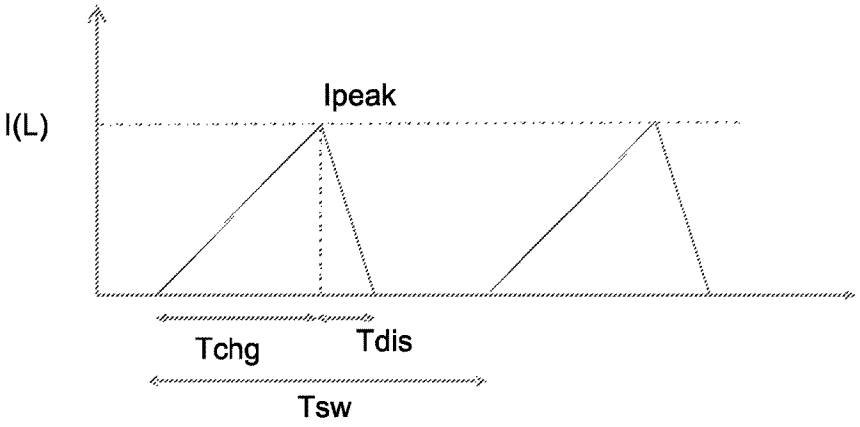
FIG. 13 shows a schematic depiction of inductor current of an LED driver circuit of (Appendix I, Appendix II).

FIG. 12 shows a depiction of an exemplary computing system 1200 such as a personal computing system (e.g., desktop or laptop) or a mobile or handheld computing system such as a tablet device or smartphone. As observed in FIG. 12, the basic computing system may include a central processing unit 1201 (which may include, e.g., a plurality of general purpose processing cores and a main memory controller disposed on an applications processor or multi-core processor), system memory 1202, a display 1203 (e.g., touchscreen, flat-panel), a local wired point-to-point link (e.g., USB) interface 04, various network I/O functions 1205 (such as an Ethernet interface and/or cellular modem subsystem), a wireless local area network (e.g., WiFi) interface 1206, a wireless point-to-point link (e.g., Bluetooth) interface 1207 and a Global Positioning System interface 1208, various sensors 1209_1 through 1209_N (e.g., one or more of a gyroscope, an accelerometer, a magnetometer, a temperature sensor, a pressure sensor, a humidity sensor, etc.), a camera 1210, a battery 1211, a power management control unit 1212, a speaker and microphone 1213 and an audio coder/decoder 1214. The display 1203 may be an LED display that is driven by an LED driver circuit as described herein.

An applications processor or multi-core processor 1250 may include one or more general purpose processing cores 1215 within its CPU 1201, one or more graphical processing units 1216, a memory management function 1217 (e.g., a memory controller) and an I/O control function 1218. The general purpose processing cores 1215 typically execute the operating system and application software of the computing system. The graphics processing units 1216 typically execute graphics intensive functions to, e.g., generate graphics information that is presented on the display 1203. The memory control function 1217 interfaces with the system memory 1202. During operation, data and/or instructions are typically transferred between deeper non volatile (e.g., "disk") storage 1220 and system memory 1202. The power management control unit 1212 generally controls the power consumption of the system 1200.

Each of the touchscreen display 1203, the communication interfaces 1204-1207, the GPS interface 1208, the sensors 1209, the camera 1210, and the speaker/microphone codec 1213, 1214 all can be viewed as various forms of I/O (input and/or output) relative to the overall computing system including, where appropriate, an integrated peripheral device as well (e.g., the camera 1210). Depending on implementation, various ones of these I/O components may be integrated on the applications processor/multi-core processor 1250 or may be located off the die or outside the package of the applications processor/multi-core processor 1250.

Embodiments of the invention may include various processes as set forth above. The processes may be embodied in machine-executable instructions. The instructions can be used to cause a general-purpose or special-purpose processor to perform certain processes. Alternatively, these processes may be performed by specific hardware components that contain hardwired logic for performing the processes, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, FLASH memory, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

APPENDIX I

Derivation of the polynomial function dependency of optimum switching frequency FSW.

FIG. 1 Inductor coil current charging & discharging from the LED driver

The current in the coil is as shown above,

1. Coil Charge equation: [VBAT−VCMP]/L=Ipeak/Tchg during time Tchg
2. Coil Discharge equation: [VLED+Vfd−VBAT]/L=Ipeak/Tdis; Vfd→shotcky diode during time Tdis
3. Tsw=1/FSW; Switching time or switching frequency of the LED Driver VBAT—Supply; VCMP is the comparator value which sets the peak current; Rshunt—Sense resistor; Vfd—schottky diode forward voltage; L—coil value The coil charging time is measured by counting the number of clock cycles till the peak current is reached & the count is K1, 4. Tchg=[K1*TCLK]
5. Average Led current "Iavg_led" is dimmed in 100 steps (Intensity: 0-100) from the maximum value "Imax_led"; Iavg_led=(Imax_led/100) led_intensity]
6. Ipeak=VCMP/Rshunt From FIG. 9 the average LED current can be calculated as, $$Iavg_led=0.5*Ipeak*Tdis/Tsw$$

Substituting for "Tdis" from equation 2

$$Iavg_led=0.5*Ipeak*Ipeak*L/[Tsw*(VLED+Vfd-VBAT)]$$

Substituting for "L" & K1 from equation 1 & 4

$$Iavg_led=[0.5*VCMP*(VBAT-VCMP])*K1*TCLK]/[Rshunt*(VLED+Vfd-VBAT)*Tsw]$$

Substituting for "Iavg_led" from equation 5 & Tsw from equation 3

$$[Imax_led*led_intensity/100]=FSW*[0.5*VCMP*(VBAT-VCMP])*K1*TCLK]/[Rshunt*(VLED+Vfd-VBAT)]$$

Optimum Switching Frequency for a required LED intensity is given by $$FSW=[Rshunt*(VLED+vfd-VBAT)*(Imax_led/100)*led_intensity]/[0.5*VCMP*(VBAT-VCMP)*K1*TCLK]$$

The above equation can be decomposed into a function F(VBAT), as the parameters (VCMP, Rshunt, VLED & Imax_led) are constants for a given LED configuration on the application board.

Where, $$F(VBAT)=[0.5*VCMP*(VBAT-VCMP)]/[Rshunt*(VLED+Vfd-VBAT)*(Imax_led/100)]$$

$$FSW=[1/F(VBAT)]*[1/K1]*[led_intensity]*FCLK$$

or $$FSW=DIV\ by\ [F(VBAT)]*DIV\ by\ [K1]*[led_intensity]*FCLK$$

From the above equation the LED current can be accurately controlled by a Frequency locked loop determined by appropriately dividing the system clock FCLK by a polynomial function of VBAT, measured charging time count K1 & led intensity.

APPENDIX II

It can be proven from charge & discharge equations of the inductor (as shown in section appendix) that the LED driver switching frequency is a polynomial function of supply & charging time of inductor for a required LED intensity.

$$FSW=DIV\ by\ [F(VBAT)]*DIV\ by\ [K1]*[led_intensity]*FCLK]$$

(for derivation see Appendix I)

FSW: LED Driver switching frequency,

F(VBAT): polynomial function of supply, led_intensity: desired LED brightness &

FCLK: System clock

A frequency locked loop which consists of dividers of supply function F(VBAT), charging time count (K1) & required LED intensity generates an optimum switching frequency (FSW) of the LED driver. This optimum switching frequency FSW will give an average LED current which corresponds to the required LED intensity.

Realization of DIV by K1:

Charging time of the inductor "Tchg" is measured inductor by means of a sense resistor "Rshunt" & peak current detect comparator. The number of system clock cycles (1/FCLK) taken from the start of the switching cycle to the time the comparator trips is measured & the count is programmed into the divider K1.

$$Tchg=K1*(1/FCLK)$$

FIG. 2 Inductor coil current charging & discharging from the LED driver

Realization of supply function DIV by F(VBAT):

$$F(VBAT)=[0.5*VCMP*(VBAT-VCMP)]/[Rshunt*(VLED-VBAT)*(Imax_led/100)]$$

(for derivation please see Appendix I)

The above equation is of the form p(x)/q(X) & can be approximated into a $1^{st}$ order linear function Y(VBAT)=m*VBAT+C.

Again from the coil current equations, $$Tchg(charge\ time)=Ipeak*L/(VBAT-Vcmp);$$

$$Tdis(discharge\ time)=Ipeak*L/(VLED+Vfd-VBAT);$$

Normally VLED is at least 20 to 30 times higher than Vfd & VBAT is about 10-15 times higher than VCMP & so Vfd & VCMP can be neglected to a first order approximation & the equation becomes, $$VLED=[1+(Tchq/Tdis)]*VBAT.$$

We claim:

1. An apparatus, comprising:

first and second inputs to be respectively coupled to first and second ends of a resistor;

an LED driver circuit comprising a series of frequency dividers to divide a first frequency of a clock signal to produce a frequency divided clock signal, said series of frequency dividers coupled to a frequency multiplier circuit, said frequency multiplier circuit to multiply a second frequency of said frequency divided clock signal by an amount proportional to a desired LED intensity, a first frequency divider of said series of frequency dividers coupled to one of said first and second inputs, a second frequency divider of said series of frequency dividers coupled to the other one of said first and second inputs.

2. The apparatus of claim 1 wherein said series of frequency dividers include a first frequency division stage to perform frequency division that is linear with a supply voltage.

3. The apparatus of claim 2 wherein said first stage includes a series of count circuits whose count value is configurable.

4. The apparatus of claim 2 wherein said first stage includes a count circuit to receive an output from an ADC that is coupled to receive said supply voltage.

5. The apparatus of claim 2 wherein said first stage includes a count circuit to receive a trigger signal that causes said count circuit to begin counting cycles of said clock signal.

6. The apparatus of claim 1 wherein said series of frequency dividers include a following frequency division stage that follows a preceding frequency division stage, the preceding frequency division stage to perform linear frequency division as a function of supply voltage, the following frequency division stage to perform corrective frequency division upon the linear frequency division.

7. The apparatus of claim 6 wherein the corrective frequency division is a parabolic function of said supply voltage.

8. The apparatus of claim 7 wherein the LED driver circuit includes register space to programmably receive parameters of a parabola to provide to said following frequency division stage.

9. An apparatus, comprising:

an LED driver circuit having a first input to receive a first voltage from a first end of a resistor, said LED driver circuit having a second input to receive a second voltage from a second end of said resistor, said resistor to be placed in series with an inductor, said inductor to boost a supply voltage to drive a series of LEDs, said LED driver circuit including circuitry to establish a frequency of a current of said inductor and determine an over current condition by measuring said first and second voltages, said LED driver circuit further including circuitry to determine an open LED condition by measuring one of said first and second voltages and measuring a voltage of said series of LEDs provided at a third input of said LED driver circuit.

10. The apparatus of claim 9 wherein said resistor is to be placed external to a semiconductor chip on which said LED driver circuit is disposed.

11. The apparatus of claim 9 wherein said LED driver circuit includes register space to receive programmed values that are provided to frequency division stages.

12. The apparatus of claim 11 wherein said frequency division stages are coupled to a frequency multiplier circuit to determine said frequency of said current of said inductor.

13. A computing system, comprising:

a plurality of processing cores;

a memory controller coupled to said plurality of processing cores;

an LED display;

an LED display driver coupled to said LED display, said LED display driver comprising:

a) first and second inputs to be respectively coupled to first and second ends of a resistor; and b) an LED driver circuit comprising a series of frequency dividers to divide a first frequency of a clock signal to produce a frequency divided clock signal, said series of frequency dividers coupled to a frequency multiplier circuit, said frequency multiplier circuit to multiply a second frequency of said frequency divided clock signal by an amount proportional to a desired LED intensity, a first frequency divider of said series of frequency dividers coupled to one of said first and second inputs, a second frequency divider of said series of frequency dividers coupled to the other one of said first and second inputs.

14. The computing system of claim 13 wherein said series of frequency dividers include a first frequency division stage to perform frequency division that is linear with a supply voltage.

15. The computing system of claim 14 wherein said first stage includes a series of count circuits whose count value is configurable.

16. The computing system of claim 14 wherein said first stage includes a count circuit to receive an output from an ADC that is coupled to receive said supply voltage.

17. The computing system of claim 14 wherein said first stage includes a count circuit to receive a trigger signal that causes said count circuit to begin counting cycles of said clock signal.

18. The computing system of claim 13 wherein said series of frequency dividers include a following frequency division stage that follows a preceding frequency division stage, the preceding frequency division stage to perform linear frequency division as a function of supply voltage, the following frequency division stage to perform corrective frequency division upon the linear frequency division.

19. The computing system of claim 18 wherein the corrective frequency division is a parabolic function of said supply voltage.

20. The computing system of claim 19 wherein the LED driver circuit includes register space to programmably receive parameters of a parabola to provide to said following frequency division stage.

* * * * *